US008396190B2

(12) United States Patent
Ahn et al.

(10) Patent No.: US 8,396,190 B2
(45) Date of Patent: Mar. 12, 2013

(54) LIQUID TARGET PRODUCING DEVICE BEING ABLE TO USE MULTIPLE CAPILLARY TUBE AND X-RAY AND EUV LIGHT SOURCE DEVICE WITH THE LIQUID TARGET PRODUCING DEVICE

(75) Inventors: Byung-Nam Ahn, Pohang-si (KR); Dong-Eon Kim, Pohang-si (KR); Jin-Gon Kim, Pohang-si (KR); Jae-Sik Son, Incheon (KR); Dong-Su Kim, Gyeongiu-si (KR)

(73) Assignees: VMT Co., Ltd, Gyeongbuk (KR); Potech Academy-Industry Foundation, Gyeongbuk (KR)

( * ) Notice: Subject to any disclaimer, the term of this patent is extended or adjusted under 35 U.S.C. 154(b) by 394 days.

(21) Appl. No.: 12/675,436

(22) PCT Filed: Aug. 28, 2008

(86) PCT No.: PCT/KR2008/005053

§ 371 (c)(1),
(2), (4) Date: Feb. 26, 2010

(87) PCT Pub. No.: WO2009/028884

PCT Pub. Date: Mar. 5, 2009

(65) Prior Publication Data

US 2011/0051897 A1 Mar. 3, 2011

(30) Foreign Application Priority Data

Aug. 28, 2007 (KR) ..... 10-2007-0086476

(51) Int. Cl.
*H01J 35/08* (2006.01)
*H01J 35/12* (2006.01)
*H01J 35/00* (2006.01)

(52) U.S. Cl. ..... 378/119; 378/143; 378/199; 250/432 R

(58) Field of Classification Search ..... 378/91, 378/119, 143, 199, 201, 204, 210; 313/231.31, 313/231.01, 231.41, 361.1, 362.1, 363.1; 315/111.01, 111.21, 111.31, 111.81; 250/432 R
See application file for complete search history.

(56) References Cited

U.S. PATENT DOCUMENTS 5,081,397 A * 1/1992 Liang et al. ..... 315/111.21
6,586,757 B2 * 7/2003 Melnychuk et al. ..... 250/504 R
6,711,233 B2 3/2004 Hertz
6,815,700 B2 * 11/2004 Melnychuk et al. ..... 250/504 R
(Continued)

FOREIGN PATENT DOCUMENTS

JP 2006-221529 8/2006
KR 10-2003-90745 11/2003
(Continued)

*Primary Examiner* — Anastasia Midkiff
(74) *Attorney, Agent, or Firm* — Yancy IP Law, PLLC

(57) ABSTRACT

A liquid target producing device to which multiple capillary tubes are mountable includes a capillary tube for injecting a liquid target in a jet form; a gas storage tank connected to the capillary tube through a gas line to store a gas to be supplied to the capillary tube; a metal jacket positioned at an outer circumference of the capillary tube such that a plurality of capillary tubes are installable thereto, the metal jacket liquefying the gas supplied through the gas line; a cryo-cooler connected to the metal jacket through a thermal conductive wire to cool the metal jacket; and a moving means for moving the metal jacket so as to set an initial position of the capillary tube.

13 Claims, 3 Drawing Sheets

U.S. PATENT DOCUMENTS

| | | | | |
|---|---|---|---|---|
| 6,835,944 | B2 * | 12/2004 | Orsini et al. | 250/504 R |
| 6,862,339 | B2 | 3/2005 | Richardson | |
| 6,864,497 | B2 * | 3/2005 | Orsini et al. | 250/504 R |
| 7,239,686 | B2 | 7/2007 | Berglund | |
| 7,589,337 | B2 * | 9/2009 | Bykanov et al. | 250/504 R |
| 2006/0193997 | A1 * | 8/2006 | Bykanov | 427/585 |
| 2006/0232215 | A1 * | 10/2006 | Bogatu | 315/111.31 |
| 2007/0001130 | A1 * | 1/2007 | Bykanov et al. | 250/493.1 |

FOREIGN PATENT DOCUMENTS

| | | |
|---|---|---|
| KR | 10-2006-0011267 | 2/2006 |
| KR | 10-0617603 | 9/2006 |
| KR | 10-2007-0076164 | 7/2007 |
| KR | 10-0773117 | 11/2007 |

* cited by examiner

LIQUID TARGET PRODUCING DEVICE BEING ABLE TO USE MULTIPLE CAPILLARY TUBE AND X-RAY AND EUV LIGHT SOURCE DEVICE WITH THE LIQUID TARGET PRODUCING DEVICE

TECHNICAL FIELD

The present invention relates to a liquid target producing device being able to use multiple capillary tubes and a X-ray and EUV light source device with the same, and more particularly to a liquid target producing device being able to having a plurality of capillary tubes that inject in a jet form a target such as a material that is in a liquid state at a normal temperature or that is liquefied though it is in a gas state at a normal temperature, a material obtained by putting nano particles into the liquid or liquefied material, or a metal liquid obtained by melting a metal with a low melt point using heat, and a light source device for generating a light with wavelength in X-ray (1~10 nm) and EUV (Extreme Ultraviolet) (10~20 nm) regions by irradiating a laser to the jet-form liquid target.

BACKGROUND ART

A light having a wavelength of 1 to 10 nanometers is called soft X-ray. This soft X-ray is used for a microscope used for observing a fine structure of living cells. Also, EUV having a wavelength of 10 to 20 nanometers is used for next-generation lithography. In particular, soft X-ray having a wavelength of 2 to 4 nanometers is very suitably used for a microscope. It is because the soft X-ray exhibits a great transmittance difference for protein and water in the wavelength region of 2 to 4 nanometers (hereinafter, referred to as "water window" region). Namely, the soft X-ray in the water window region has good transmittance for water but bad transmittance for protein, so it is a very suitable light source for investigating a cell interior structure.

Strong soft X-ray is generated in synchrotron facilities. However, the synchrotron facilities are very huge experiment devices, which consume a lot of time and cost. Thus, the synchrotron facilities are not suitable for being used in a small laboratory.

In a small laboratory, a laser plasma light source generator is used as a light source generator. The laser plasma light source generator irradiates a high power laser beam to a target arranged in a vacuum container to generate a light. If a high power laser beam is concentrated on the target, high density plasma is produced. The produced plasma is freely expanded in the vacuum container, and the light is generated from the expanded plasma.

The laser plasma light source generator can generate a light with a wavelength in X-ray and EUV regions depending on the target. For example, a light with a wavelength of 13.5 nanometers for extreme ultraviolet lithography can be generated when a material such as xenon (Xe), lithium (Li) and tin (Sn) is used as a target, and a light in the water window region can be generated when a material including nitrogen (N) atom or carbon (C) atom is used.

However, in case a solid target composed of the above atoms is used, if the density of nitrogen atoms or carbon atoms in the solid target is not high, the intensity of generated light is relatively low.

Also, if a high power laser is irradiated to only a certain portion of a solid target, the laser concentrated area is deformed. Thus, it is required to rotate or vertically/horizontally move the solid target such as the laser may be always input to a new area, which however needs a driving mechanism. Also, the solid target should be exchanged after once used. Thus, there is a lot of inconvenience in use, and a lot of time and cost is consumed.

In addition, if a solid target is used, scattering particles (hereinafter, referred to as "debris") such as pyrolysate or chips are emitted from the solid target together with the soft X-ray and EUV. This debris is scattered and floating in all directions. In particular, the laser beam has a high out-put, the debris has a very increased speed. Such debris may damage expensive surrounding optical devices, which is considered as the most serious problem.

In order to solve this problem, the applicant filed a patent application in Korea, entitled "an X-ray and EUV light source generator using a liquid target", on Sep. 23, 2005, which is registered (Registration No. 0617603).

However, according to the light source generator disclosed in the Korean Patent Registration No. 0617603, a liquid target supplier having only one capillary tube is coupled to a vacuum chamber. Thus, first, in case the capillary tube is damaged, the capillary tube should be exchanged, which demands much time. Second, when it is intended to inject another kind of liquid target from the capillary tube, a gas supplied to the capillary tube should be exchanged.

In addition, according to the light source generator disclosed in the Korean Patent Registration No. 0617603, it is impossible to control temperature of a cooling solvent used for liquefying the supplied gas. Thus, first, the kind of supplied gas is limited to one having a higher liquefaction temperature than the temperature of the cooling solvent. Second, when it is intended to use a gas with a lower liquefaction temperature than the temperature of the coolant solvent for forming a liquid target, the cooling solvent should be exchanged with a cooling solvent with a lower temperature than the liquefaction temperature of the gas.

DISCLOSURE

Technical Problem

The present invention is designed to solve the problems of the prior art, and therefore it is an object of the present invention to provide a liquid target producing device, which allows easier and faster exchange of a capillary tube in comparison to a conventional case in case the capillary tube should be exchanged due to damage or the like, and which does not require exchange of a gas supplied to the capillary tube though different kinds of liquid targets should be injected from the capillary tube.

Also, an object of the present invention is to provide a liquid target producing device to which multiple capillary tubes capable of using various kinds of gases with different liquefaction temperatures as a liquid target can be mounted.

In addition, an object of the present invention is to provide a X-ray and EUV light source device having the liquid target producing device being able to use multiple capillary tubes.

Technical Solution

In order to accomplish the above object, the present invention provides a liquid target producing device to which multiple capillary tubes are mountable, the device including: a capillary tube for injecting a liquid target in a jet form; a gas storage tank connected to the capillary tube through a gas line to store a gas to be supplied to the capillary tube; a metal jacket positioned at an outer circumference of the capillary tube such that a plurality of capillary tubes are installable thereto, the metal jacket liquefying the gas supplied through the gas line; a cryo-cooler connected to the metal jacket through a thermal conductive wire to cool the metal jacket; and a moving means for moving the metal jacket so as to set an initial position of the capillary tube.

Preferably, the moving means includes a support for fixing the metal jacket, the support being configured with a thermal insulation member; and a 3-axis stage for moving the support in X-axis, Y-axis and Z-axis directions.

Preferably, the liquid target producing device may further include a pressure regulator mounted on the gas line to apply a pressure to the gas supplied to the capillary tube.

Preferably, the liquid target producing device may further include a purifier mounted on the gas line to filter off an impurity included in the gas supplied to the capillary tube.

Preferably, the liquid target producing device may further include a mass flow controller mounted on the gas line to keep an amount of the gas supplied to the capillary tube constantly.

Preferably, a surface of the capillary tube contacting with the metal jacket is coated with silver epoxy and surrounded by an indium foil.

Preferably, the liquid target producing device may further include a temperature controller for automatically controlling the cryo-cooler such that a temperature of the metal jacket is kept constantly.

In another aspect of the present invention, there is also provided a X-ray and EUV (Extreme Ultraviolet) light source device, which includes a vacuum chamber; a vacuum pumping system mounted to the vacuum chamber to keep a degree of vacuum in the vacuum chamber within a predetermined range; a liquid target producing device mounted to the vacuum chamber to supply a liquid target into the vacuum chamber; a liquid target sucking device mounted to the vacuum chamber to sucking the liquid target supplied into the vacuum chamber; and a laser supplier mounted to the vacuum chamber to supply a laser to be irradiated to the liquid target supplied into the vacuum chamber, wherein the liquid target producing device includes a capillary tube for injecting the liquid target in a jet form; a gas storage tank connected to the capillary tube through a gas line to store a gas to be supplied to the capillary tube; a metal jacket positioned at an outer circumference of the capillary tube such that a plurality of capillary tubes are installable thereto, the metal jacket liquefying the gas supplied through the gas line; a cryo-cooler connected to the metal jacket through a bundle of thermal conductive wires to cool the metal jacket; and a moving means for moving the metal jacket so as to set an initial position of the capillary tube.

Preferably, the moving means includes a support for fixing the metal jacket, the support being configured with a thermal insulation member; and a 3-axis stage installed in the vacuum chamber to move the support in X-axis, Y-axis and Z-axis directions.

Preferably, the X-ray and EUV light source device may further include a frame installed out of the vacuum chamber to support the cryo-cooler, wherein the frame and the vacuum chamber are connected with each other by a flexible tube.

Preferably, the vacuum pumping system and the vacuum chamber are connected with each other by a damper (222) composed of a flexible tube and a vibration-proof rubber.

Preferably, the liquid target producing device further includes a PEEK (polyetheretherketone) union for connecting the capillary tube to the gas line.

Preferably, the liquid target producing device further includes a pressure regulator mounted on the gas line to apply a pressure to the gas supplied to the capillary tube.

Preferably, the liquid target producing device further includes a purifier mounted on the gas line to filter off an impurity included in the gas supplied to the capillary tube.

Preferably, the liquid target producing device further includes a mass flow controller mounted on the gas line to keep an amount of the gas supplied to the capillary tube constantly.

Preferably, a surface of the capillary tube contacting with the metal jacket is coated with silver epoxy and surrounded by an indium foil.

Preferably, the liquid target producing device further includes a temperature controller for automatically controlling the cryo-cooler such that a temperature of the metal jacket is kept constantly.

Advantageous Effects

According to the present invention, in case a capillary tube should be exchanged due to damage, the capillary tube can be exchanged in an easier and faster way than a conventional case.

Also, when it is intended to inject different kinds of liquid targets, there is no need to exchange the gas supplied to the capillary tube, so the exchanging work for the liquid target can be executed in an easier and faster way than a conventional case.

In addition, the present invention allows to form various kinds of gases with different liquefaction temperatures as a liquid target without exchange of a cooling solvent, so the range of available gases can be expanded in a more convenient way than a conventional case.

BEST MODE

Hereinafter, preferred embodiments of the present invention will be described in detail with reference to the accompanying drawings.

Figure 1:
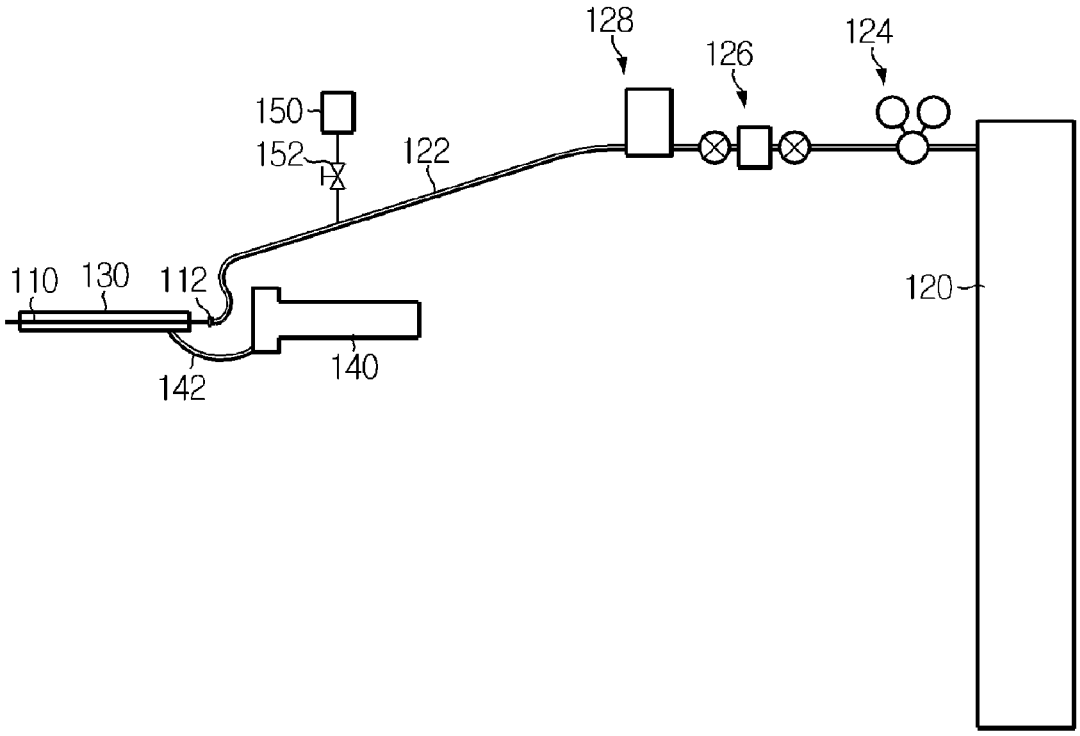
FIG. 1 is a schematic view showing a liquid target producing device according to the present invention.
Figure 2:
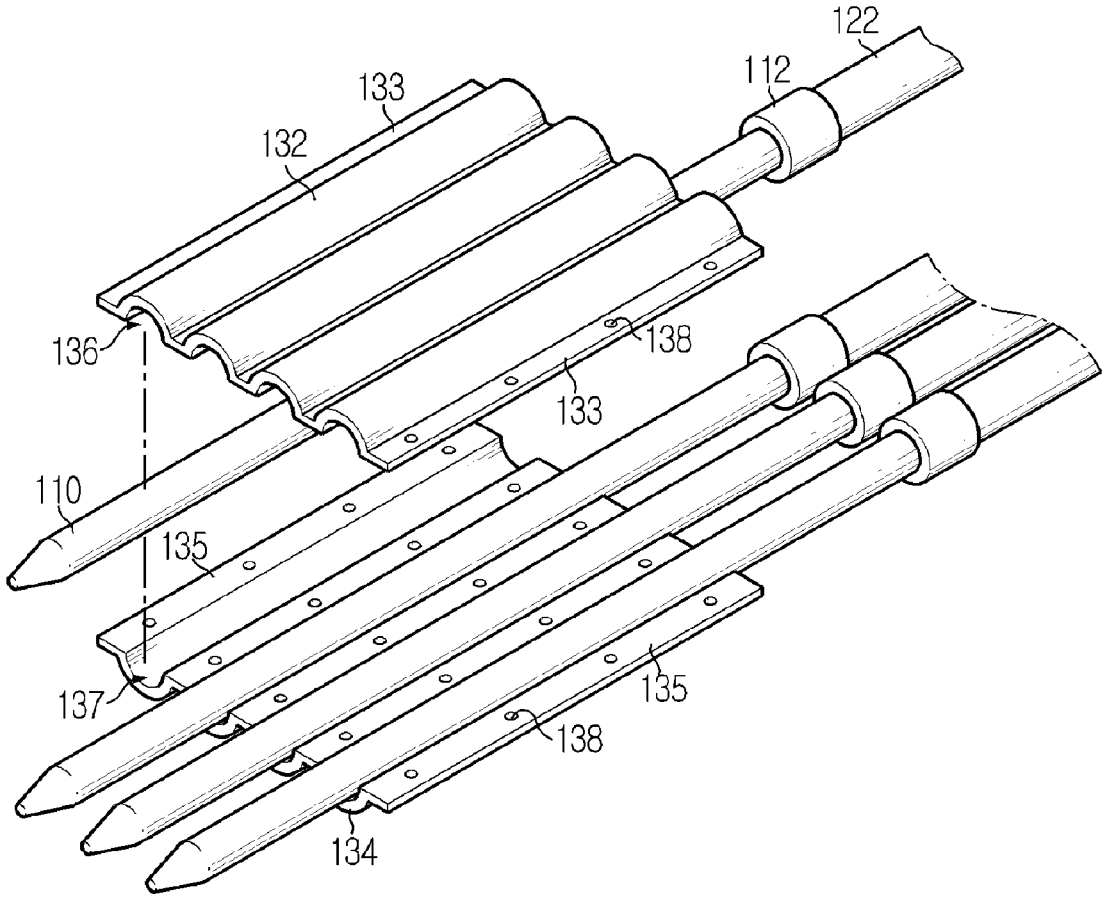
FIG. 2 is a partially exploded perspective view showing a metal jacket and capillary tubes of FIG. 1.

FIG. 1 is a schematic view showing a liquid target producing device according to the present invention, and FIG. 2 is a partially exploded perspective view showing a metal jacket and capillary tubes of FIG. 1.

A liquid target producing device according to the present invention includes a capillary tube 110, a gas storage tank 120, a metal jacket 130, a cryo-cooler 140, a temperature controller (not shown), and a moving means 250, 260 (see FIG. 3), as shown in FIG. 1. Hereinafter, these components are explained in detail, but the moving means 250, 260 are explained when a X-ray and EUV light source device according to the present invention is described.

The capillary tube 110 is provided at the liquid target producing device. The number of capillary tubes provided at the liquid target producing device may be one or more, but preferably a plurality of capillary tubes are provided. A tapered nozzle is formed at one end of the capillary tube 110, and a liquid target is injected in a jet form through the nozzle. To make the capillary tube 110, first, a commercialized product made of silica material, which has an outer diameter of 360 micrometers and an inner diameter of 100 to 150 micrometers and which is coated with polyimide on its outside for preventing easy breakage, is cut, using a silica capillary tube cutting tool, by as much as 300 millimeters such that the cut surface of the capillary tube becomes smooth. Then, a micro torch is used to burn and peel the coating at one end of the capillary tube 110 by as much as 10 millimeters, and then a laser processing machine is used to apply heat and tension to the peeled end of the capillary tube 110 at regular cycles, thereby making a nozzle that has a diameter of 5 to 20 micrometers at its end. In case the diameter at the tube end is less than 5 micrometers, the nozzle may be easily clogged. If the diameter is greater than 20 micrometers, it is difficult to form a jet.

The gas storage tank 120 is used for storing a gas to be supplied to the capillary tube 110. Preferably, there are provided the same number of gas storage tanks as the number of capillary tubes 110. The kind of gas stored in the gas storage tank 120 is determined depending on the kind of light to be generated. For example, in case it is intended to generate a light with a wavelength in the water window region, nitrogen gas is stored in the gas storage tank 120. Meanwhile, if it is intended to generate EUV (Extreme Ultraviolet), xenon (Xe) or krypton (Kr) gas is stored in the gas storage tank 120. In case a plurality of gas storage tanks 120 are provided, gases stored in the gas storage tanks 120 may be of the same kind or different kinds. Also, all gas storage tanks, except for a gas storage tank connected to a capillary tube actually injecting a liquid target, are closed when the liquid target producing device is operated.

The gas storage tank 120 is connected to the capillary tube 110 through a gas line 122. The gas line 122 is preferably formed with a electro-polished stainless steel tube. The gas line 122 and the capillary tube 110 are connected with each other by means of a union 112 made of PEEK (polyetheretherketone). The gas line 122 is made of stainless steel with a diameter of 1/16", and the capillary tube 110 is made of silica with an outer diameter of 360 micrometers. The union 112 connects two tubes with different diameters and materials. The union 112 may be fastened and loosed manually, so the capillary tube 110 may be easily connected to or detached from the gas line 122.

Preferably, a pressure regulator 124 is mounted to the gas line 122. The pressure regulator 124 applies a high pressure to the gas to be supplied to the capillary tube 110 such that a liquid target injected from the nozzle formed at one end of the capillary tube 110 may form a stable jet form in a predetermined region, preferably in a region between the nozzle and a location spaced apart from the nozzle by about 700 micrometers or more. If the jet stable region is short, a laser irradiation portion is so close to the end of the capillary tube 110 that the end of the capillary tube 110 may be damaged by a high temperature heat generated when plasma is generated.

Preferably, a purifier 126 is mounted to the gas line 122. The purifier 126 purifies remaining impurities of about 1 ppm level, included in the ultra pure gas of 99.9999% or above stored in the gas storage tank 120, up to 1 ppb level.

Preferably, a mass flow controller 128 is mounted to the gas line 122 such that an amount of gas supplied to the capillary tube 110 is kept constantly. If an amount of gas supplied to the capillary tube 110 is constant, the liquid target injected in a jet form from the nozzle formed at one end of the capillary tube 110 may be more stably formed.

Preferably, a vacuum pump 150 is connected to the gas line 122 such that the gas line 122 contaminated by impurities such as air and dust at initial installation or exchange of the gas storage tank 120 may be made into an ultra pure gas line, and a valve 152 is mounted to a pipe that connects the vacuum pump 150 and the gas line 122. If the gas storage tank 120 is connected to the gas line 122, the valve 152 is opened while gas supply from the gas storage tank 120 is intercepted, and then the vacuum pump 150 is operated so as to eliminate impurities such as air and dust in the gas line 122. At this time, for enhancing the efficiency of the impurity eliminating work, the entire gas line 122 is preferably baked over 100° C. If this state is kept for a predetermined time, heating of the gas line 122 is stopped, and the ultra pure gas stored in the gas storage tank 120 is flowed to the gas line 122 five to ten times, thereby forming an ultra pure gas line. At this time, since the valve 152 is still open, the gas supplied to the gas line 122 is introduced into the vacuum pump 150. If the ultra pure gas line is completely formed, the valve 152 is closed, and the vacuum pump 150 is stopped.

The metal jacket 130 is installed to surround an outer circumference of the capillary tube 110 and liquefies the gas supplied through the gas line 122. The metal jacket 130 is composed of first and second jackets 132, 134, which configure a shape in which a plurality of semicircular pillars are connected with each other as shown in FIG. 2. Also, the metal jacket 130 is made of oxygen-free copper coated with gold or silver. Flanges 133, 135 are formed at both side ends of the first and second jackets 132, 134, and a plurality of grooves 136, 137 with a semicircular pillar shape extended in a length direction are formed in the first and second jacket 132, 134. The first and second jackets 132, 134 are coupled using an adhesive with great thermal conductivity such as silver epoxy, a bolt inserted into a bolt hole 138 formed in the flange 133, 135, and a nut coupled with the bolt. When the first and second jackets 132, 134 are completely coupled, the capillary tube 110 is seated in the grooves 136, 137. Geometric parameters of the metal jacket 130 such as length and thickness are determined in consideration of kind of the gas, mass flow or flux of the gas, cooling capability of the cryo-cooler 140, and so on such that the gas introduced into the capillary tube 110 may be sufficiently liquefied while passing through a region where the metal jacket 130 is installed. Meanwhile, a heat protection film (not shown) may be attached to the surface of the metal jacket 130 so as to prevent the metal jacket 130 from being influenced by heat generated from various units mounted to a vacuum chamber 210, explained later.

Among the surface of the capillary tube 110, a portion contacting with the metal jacket 130 is preferably coated with silver epoxy and then surrounded by an indium foil. By treating the surface of the capillary tube 110 in this way, heat transfer efficiency between the capillary tube 110 and the metal jacket 130 can be more improved.

The cryo-cooler 140 cools the metal jacket 130 to a very low temperature. Generally, a cryo-cooler means a cooling system that generates a temperature of 120K or below, and it is classified into a recuperative type and a regenerative type depending on the type of a heat exchanger. In this embodiment, a regenerative type cryo-cooler that has a small capacity and generates a temperature of 10K or above is preferably used, but not limited thereto. The cryo-cooler generally includes a cooler unit receiving a cold storage medium and having an expansion chamber therein, and a compressor unit receiving a compressor body, and the cooler unit is installed to a device or container that should be cooled to an ultra low temperature. Meanwhile, a heat protection film (not shown) may be attached to a surface of the cryo-cooler 140 so as to prevent the cryo-coolant 140 from being influenced by the heat generated from various units mounted to the vacuum chamber 210, explained later.

The cooler unit (not shown) of the cryo-cooler 140 and the metal jacket 130 are connected with each other by means of a bundle of thermal conductive wires 142. The bundle of thermal conductive wires 142 is made by twisting a plurality of thermal conductive wires made of oxygen-free copper coated with gold or silver. Also, the bundle of thermal conductive wires 142 and the cooler unit are adhered to each other by silver epoxy, and the bundle of thermal conductive wires 142 and the metal jacket 130 are also adhered to each other by silver epoxy. The heat of ultra low temperature generated by the cooler unit of the cryo-cooler 140 is transferred to the metal jacket 130 through the bundle of thermal conductive wires 142, and thus the metal jacket 130 is cooled to a very low temperature, preferably to a temperature capable of sufficiently liquefying various kinds of gases supplied from the gas storage tank 120.

Geometric parameters of the bundle of thermal conductive wires 142 such as length and number should be determined such that the vibration generated from the compressor unit of the cryo-cooler 140 is not transferred to the metal jacket and at the same time such that the heat of ultra low temperature generated by the cooler unit can be efficiently transferred to the metal jacket 130.

Meanwhile, a heat protection film (not shown) may be attached to the surface of the bundle of thermal conductive wires 142 so as to prevent the bundle of thermal conductive wires 142 from being influenced by heat generated from various units mounted to the vacuum chamber 210, explained later.

The liquid target producing device preferably further includes a temperature controller (not shown) for automatically keeping the temperature of the metal jacket 130 constantly. In this case, the liquid target injected from the nozzle formed at one end of the capillary tube 110 can be more stably formed.

The temperature controller (not shown) can be provided in various forms. For example, the temperature controller may include a temperature sensor (not shown) mounted to the metal jacket 130 to detect a temperature of the metal jacket 130 in real time, a cartridge heater (not shown) installed to the cooler unit of the cryo-cooler 140, and a controller (not shown) for comparing the temperature detected by the temperature sensor with a predetermined criterion temperature and applying a voltage to the cartridge heater when both temperatures are different from each other. Also, as another alternative, the temperature may include a temperature sensor (not shown) as explained above, and a controller (not shown) for comparing the temperature detected by the temperature sensor with a predetermined criterion temperature and controlling the number of rotation of a motor mounted to the compressor unit of the cryo-cooler 140 when both temperatures are different from each other. The predetermined criterion temperature can be changed depending on the kind of gas supplied from the gas storage tank 120.

Hereinafter, a X-ray and EUV (Extreme Ultraviolet) light source device according to the present invention is explained with reference to the following examples and the accompanying drawings.

Figure 3:
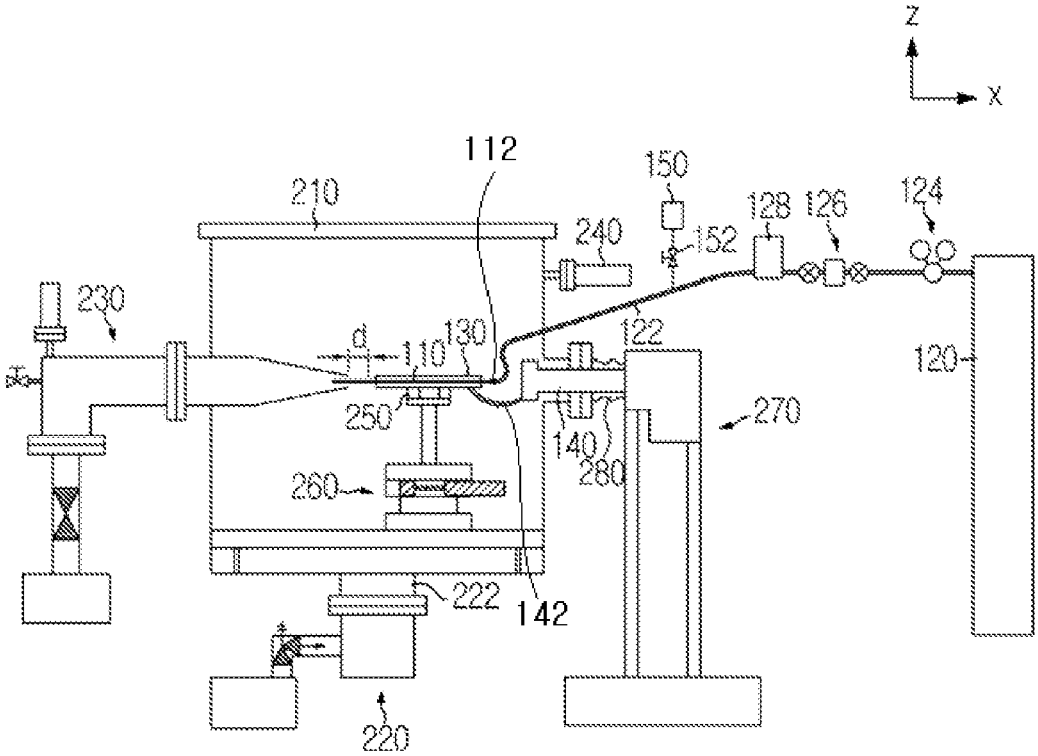
FIG. 3 is a schematic view showing a X-ray and EUV light source device having the liquid target producing device of FIG. 1.

FIG. 3 is a schematic view showing a X-ray and EUV light source device having the liquid target producing device of FIG. 1. In FIG. 3, the same reference numeral as in FIG. 1 designates the same component as in FIG. 1.

The X-ray and EUV light source device according to the present invention includes a vacuum chamber 210, a vacuum pumping system 220, a liquid target producing device, a liquid target suction device 230 and a laser supplier (not shown). The liquid target producing device is already explained above, so it is not described in detail again.

The vacuum pumping system 220 is mounted to one side of the vacuum chamber 210.

The vacuum pumping system 220 generates vibrations in itself. However, if such vibrations are transferred to the vacuum chamber 210, a liquid target cannot be injected stably from the capillary tube 110. Thus, it is required to prevent the vibrations of the vacuum pumping system 220 from being transferred to the vacuum chamber 210. In this embodiment, in order to prevent the vibrations of the vacuum pumping system 220 from being transferred to the vacuum chamber 210, a damper 222 composed of a flexible tube and a vibration-proof rubber is used to connect the vacuum pumping system 220 and the vacuum chamber 210.

The laser supplier (not shown) is mounted to the vacuum chamber 210 to generate a laser to be irradiated to the liquid target injected from the capillary tube 110. The high output laser supplied from the laser supplier forms a plasma together with the liquid target in the vacuum chamber 210. A condensing lens (not shown) may be positioned on a laser path such that the high output laser may be intensively irradiated to the liquid target.

The liquid target suction device 230 is mounted to the vacuum chamber 210 such that it is positioned to face the liquid target producing device, more specifically to face an actually used capillary tube among the plurality of capillary tubes 110 provided at the liquid target producing device. The liquid target is continuously supplied into the vacuum chamber 210 from an actually used capillary tube among the plurality of capillary tubes 110, and emitted out of the vacuum chamber 210 by the liquid target suction device 230.

In order to continuously generate X-rays or EUV rays with strong intensity, the liquid target introduced into the vacuum chamber 210 is discharged out of the vacuum chamber 210 using the liquid target suction device 230.

A distance (d) between one end of the capillary tube 110 and one end of the liquid target suction device 230 is preferably about 5 to 10 millimeters. If this distance (d) is too great, a liquid target suction rate of the liquid target suction device 230 is lowered, so the degree of vacuum in the vacuum chamber 210 is lowered. If the distance (d) is too small, the end of the capillary tube 110 becomes close to a portion where plasma is generated, so the capillary tube 110 may be easily damaged from the heat generated by the plasma.

A photo-diode (not shown) is preferably mounted in the vacuum chamber 210. The photodiode is used to measure the intensity of X-rays or EUV rays generated in the vacuum chamber 210. In case a high output laser condition or a liquid target stage is changed, the intensity of generated X-rays or EUV rays become unstable, so it is required to continuously measure the intensity of X-rays or EUV rays.

A tele-zoom microscope (not shown) is preferably mounted to one side of the vacuum chamber 210. In order to generate X-ray or EUV with a suitable intensity, a high output laser should be accurately irradiated to a liquid target. The tele-zoom microscope allows to check whether a high output laser is accurately irradiated to a liquid target.

A vacuum gauge 240 is preferably mounted to one side of the vacuum chamber 210. The vacuum gauge 240 allows real-time monitoring of the degree of vacuum in the vacuum chamber 210.

The metal jacket 130 of the liquid target producing device is configured to be moved by the moving means 250, 260. The metal jacket 130 is placed and fixed on a support 250 made of a thermal insulation member, and the support 250 is attached to a 3-axis stage 260 installed to an inner bottom of the vacuum chamber 210. The 3-axis stage 260 allows displacement control in X-axis, Y-axis and Z-axis directions. At initial installation of the capillary tube 110, the position of the metal jacket 130 may be accurately controlled using the 3-axis stage 260 such that an actually used capillary tube among the plurality of capillary tubes 110 and the liquid target suction device 230 may be positioned on a straight line as being spaced apart from each other. Also, in case another capillary tube should be used since a currently used capillary tube is damaged or since it is intended to form another kind of liquid target differently from a currently formed liquid target, the position of the metal jacket 130 may be accurately controlled using the 3-axis stage 260 such that an the another capillary tube and the liquid target suction device 230 may be positioned on a straight line.

Meanwhile, though it has been illustrated that the support 250 is attached to the 3-axis stage 260, the support 250 may also be attached to a 2-axis stage or a 1-axis stage, as alternatives. At this time, the 2-axis stage is configured to allow displacement control in any two directions among X-axis, Y-axis and Z-axis directions, and the 1-axis stage is configured to allow displacement control in any one direction among X-axis, Y-axis and Z-axis directions.

The cryo-cooler 140 of the liquid target producing device is attached to a frame 270 installed to an outer bottom of the vacuum chamber 210. In case the cryo-cooler 140 is attached to the frame 270 as mentioned above, it is possible to prevent vibrations generated by the compressor unit of the cryo-cooler 140 from being directly transmitted to the vacuum chamber 210.

The frame 270 is connected to the vacuum chamber 210 by means of a flexible tube 280 positioned out of the cryo-cooler 140. In case the cryo-cooler 140 is attached to the frame 270, the vibration of the cryo-cooler 140 itself is transmitted to the frame 270. The frame 270 is firmly fixed to the outer bottom of the vacuum chamber 210, so it may absorb the vibrations transmitted from the cryo-cooler 140, but not perfectly. Thus, if the cryo-cooler 140 is operated, the frame 270 is also vibrated weakly. The flexible tube 280 perfectly absorbs such weak vibrations of the frame 270, thereby preventing the vibration of the cryo-cooler 140 itself from being transmitted to the vacuum chamber 210 though the cryo-cooler 140 is in operation.

Hereinafter, installation process and operation process of the X-ray and EUV light source device are explained.

First, a plurality of capillary tubes 110 respectively connected through gas lines 122 to a plurality of gas storage tanks 120 storing gases of the same kind or different kinds are mounted to the metal jacket 130, and the metal jacket 130 is fixed on the support 250. After that, the 3-axis stage 260 is manipulated such that an actually used capillary tube among the plurality of capillary tubes 110 is positioned on a straight line with the liquid target suction device 230. At this time, all gas storage tanks are closed, except for a gas storage tank connected to the actually used capillary tube.

If the above work is completed, the degree of vacuum in the vacuum chamber 210 is controlled using the vacuum pumping system 220, and the gas line 122 is made into an ultra pure gas line. After that, the cryo-cooler 140 is operated to cool the metal jacket 130. If the metal jacket 130 is cooled below a predetermined temperature, the gas stored in the gas storage tank 120 is supplied thereto. The supplied gas is liquefied while passing through the capillary tube 110 mounted to the metal jacket 130 and then injected into the vacuum chamber 210 in a jet form, and the injected liquid target is discharged out of the vacuum chamber 210 through the liquid target suction device 230. In this process, the liquid target makes an interaction with a high output laser supplied from the laser supplier, thereby forming plasma. Also, while ionized nitrogen atoms in the plasma are changed from an excited state potential to a ground state potential, X-rays or EUV rays are generated.

If it is intended to use another capillary tube since a currently used capillary tube is damaged or since another kind of liquid target is to be generated while the light source device is in operation, a worker closes the gas storage tank connected to the currently used capillary tube, positions the another capillary tube on a straight line with the liquid target suction device 230 by using the 3-axis stage 260, and then opens a gas storage tank 120 connected to the another capillary tube.

INDUSTRIAL APPLICABILITY

The present invention may be used in industrial fields such as a manufacture of optical devices such as microscope, semiconductor production using next-generation lithography, and so on.

The invention claimed is:

1. A liquid target producing device to which multiple capillary tubes are mountable, the device comprising:

a capillary tube for injecting a liquid target in a jet form;

a gas storage tank connected to the capillary tube through a gas line and storing a gas to be supplied to the capillary tube;

a metal jacket positioned at an outer circumference of the capillary tube such that a plurality of capillary tubes are installable thereto, the metal jacket liquefying the gas supplied through the gas line;

a cryo-cooler connected to the metal jacket through a thermal conductive wire to cool the metal jacket; and a moving means for moving the metal jacket so as to set an initial position of the capillary tube.

2. The liquid target producing device according to claim 1, wherein the moving means includes:

a support for fixing the metal jacket, the support being configured with a thermal insulation member; and a 3-axis stage for moving the support in X-axis, Y-axis and Z-axis directions.

3. The liquid target producing device according to claim 1, further comprising a pressure regulator mounted on the gas line to apply a pressure to the gas supplied to the capillary tube.

4. The liquid target producing device according to claim 1, further comprising a purifier mounted on the gas line to filter off an impurity included in the gas supplied to the capillary tube.

5. The liquid target producing device according to claim 1, further comprising a mass flow controller mounted on the gas line to keep an amount of the gas supplied to the capillary tube constantly.

6. An X-ray and EUV (Extreme Ultraviolet) light source device, comprising:

a vacuum chamber;

a vacuum pumping system mounted to the vacuum chamber to keep a degree of vacuum in the vacuum chamber within a predetermined range;

a liquid target producing device mounted to the vacuum chamber to supply a liquid target into the vacuum chamber; and a liquid target sucking device mounted to the vacuum chamber to sucking the liquid target supplied into the vacuum chamber;

wherein the liquid target producing device includes:

a capillary tube for injecting the liquid target in a jet form;

a gas storage tank connected to the capillary tube through a gas line and storing a gas to be supplied to the capillary tube;

a metal jacket positioned at an outer circumference of the capillary tube such that a plurality of capillary tubes are installable thereto, the metal jacket liquefying the gas supplied through the gas line;

a cryo-cooler connected to the metal jacket through a bundle of thermal conductive wires to cool the metal jacket; and a moving means for moving the metal jacket so as to set an initial position of the capillary tube.

7. The X-ray and EUV light source device according to claim 6, wherein the moving means includes:

a support for fixing the metal jacket, the support being configured with a thermal insulation member; and a 3-axis stage installed in the vacuum chamber to move the support in X-axis, Y-axis and Z-axis directions.

8. The X-ray and EUV light source device according to claim 6, further comprising a frame installed out of the vacuum chamber to support the cryo-cooler, wherein the frame and the vacuum chamber are connected with each other by a flexible tube.

9. The X-ray and EUV light source device according to claim 6, wherein the vacuum pumping system and the vacuum chamber are connected with each other by a damper composed of a flexible tube and a vibration-proof rubber.

10. The X-ray and EUV light source device according to claim 6, wherein the liquid target producing device further includes a PEEK (polyetheretherketone) union for connecting the capillary tube to the gas line.

11. The X-ray and EUV light source device according to claim 6, wherein the liquid target producing device further includes a pressure regulator mounted on the gas line to apply a pressure to the gas supplied to the capillary tube.

12. The X-ray and EUV light source device according to claim 6, wherein the liquid target producing device further includes a purifier mounted on the gas line to filter off an impurity included in the gas supplied to the capillary tube.

13. The X-ray and EUV light source device according to claim 6, wherein the liquid target producing device further includes a mass flow controller mounted on the gas line to keep an amount of the gas supplied to the capillary tube constant.

* * * * *